United States Patent [19]

Yajima

[11] 4,135,359

[45] Jan. 23, 1979

[54] ELECTRONIC TIMEPIECE WITH THE AMENDING MEANS

[76] Inventor: Kenji Yajima, 6-31-1, Kameido, Koto-ku, Tokyo, Japan

[21] Appl. No.: 774,629

[22] Filed: Mar. 4, 1977

[30] Foreign Application Priority Data

Mar. 5, 1976 [JP] Japan ..... 51-23846

[51] Int. Cl.[2] ..... G04B 27/00

[52] U.S. Cl. ..... 58/85.5; 58/23 R; 200/4; 200/6 R

[58] Field of Search ..... 58/4 A, 23 R, 23 BA, 58/50 R, 85.5; 200/4, 52 R, 16 A, 159 R

[56] References Cited

U.S. PATENT DOCUMENTS

| | | | |
|---|---|---|---|
| 3,945,190 | 3/1976 | Kimura et al. | 58/4 A |
| 3,975,896 | 8/1976 | Kasama | 58/23 R |
| 3,978,296 | 8/1976 | Morita et al. | 200/4 |
| 4,020,627 | 5/1977 | Yoshida et al. | 58/50 R |
| 4,044,543 | 8/1977 | Ikehata et al. | 58/23 R |
| 4,057,698 | 11/1977 | Nakagana et al. | 200/16 A |

*Primary Examiner*—James R. Scott
*Assistant Examiner*—Vit W. Miska
*Attorney, Agent, or Firm*—Robert E. Burns; Emmanuel J. Lobato; Bruce L. Adams

[57] ABSTRACT

Switching functions of an electronic timepiece including switching for time amendment, are controlled by a stem which is rotatable and axially movable. When in neutral axial position, the stem is rotatable to display alternatively hours, minutes and seconds or month and date. When pulled out to its outer axial position, the stem is rotatable in one direction to select the time function (hours, minutes, month or date) to be amended and is rotatable in the opposite direction to supply pulses from a dividing circuit to the counter of the selected time function to effect the desired amendment. When pushed in to an inner axial position, the stem actuates which means to illuminate the time display.

14 Claims, 5 Drawing Figures

ELECTRONIC TIMEPIECE WITH THE AMENDING MEANS

FIELD OF INVENTION

The present invention relates to an electronic timepiece and particularly to switching mechanism operated by a stem member for time amendment and other functions.

BACKGROUND OF THE INVENTION

In the conventional electronic timepiece a time amendment is effected by a switching operation by means of one or more push buttons or the stem of the timepiece. In the push button type there is a problem of space and design for mounting the push button switch. The switch is difficult to operate because it is not possible to provide a large push button. On the contrary in the stem operated type the problem of space is easily eliminated but the mechanical construction is complicated to provide the required functions.

SUMMARY OF THE INVENTION

It is an object of the present invention to eliminate the above noted difficulties and insufficiencies of the prior art and to provide an improved electronic timepiece in which time amending functions and other switching functions are effected by manipulating the stem of the timepiece.

In accordance with the present invention the stem of an electronic timepiece is rotatable and axially movable and a cam member on the stem shaft is rotatable with the shaft but axially movable thereon. The electronic circuitry of the timepiece includes a first function-controlling switch means which is actuatable by axial movement of the stem and a second function-controlling switch means actuatable by the cam member on the stem shaft upon rotation of the stem. The second function-controlling switch means comprises first contact means operable by rotation of the stem in one direction and second contact means operable by rotation of the stem member in the opposite direction. In addition to effecting time amendment, the switch means may also perform other functions, for example selecting a time function to be displayed by the display panel of the timepiece or illuminating the display if desired.

BRIEF DESCRIPTION OF DRAWINGS

The nature, objects and advantages of the invention will be more fully understood from the following description of a preferred embodiment shown by way of example in the accompanying drawings in which.

DESCRIPTION OF PREFERRED EMBODIMENT

Figure 1:
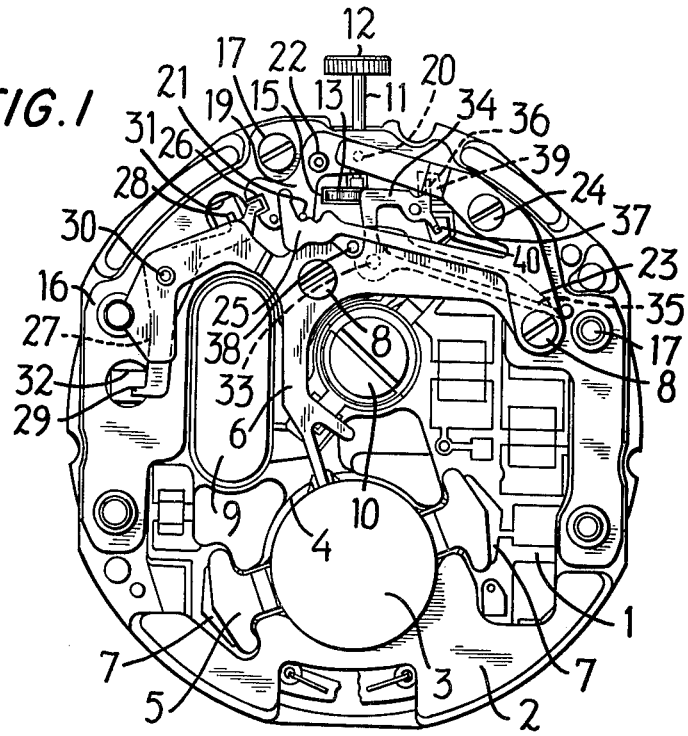
FIG. 1 is a plan view of one embodiment of an electronic timepiece in accordance with the invention with the case removed.

The embodiment of the invention shown by way of example in the drawings is an electronic watch in which circuitry and switching mechanism in accordance with the invention is mounted on a base plate 1, the outer surface of which is covered with insulated material, for example synthetic resin 2 applied by transfer molding. A battery housing portion 4 housing a cell 3 as a power source is provided in the molded portion 2 of the base plate 1. A lead electrode portion 5 which contacts one electrode of the cell 3 is connected to a circuit pattern 7 of the base plate 1. A lead electrode portion 6 which contacts the other electrode of the cell 3 is mounted on the molded portion 2 of the base plate 1 by a screw 8. A quartz element 9 of an oscillating circuit and a trimmer condenser 10 for adjustment of the oscillating frequency are mounted on the base plate 1 and are connected to the circuit pattern 7.

Figure 3:
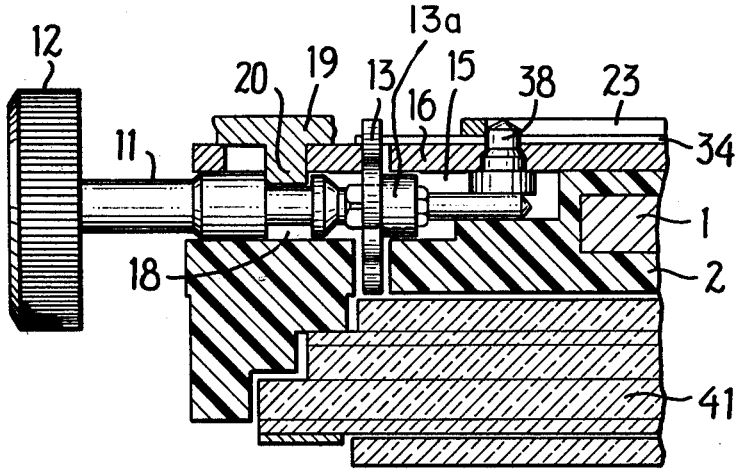
FIG. 3 is an enlarged cross sectional view of a portion of the timepiece shown in FIG. 1.
Figure 4:
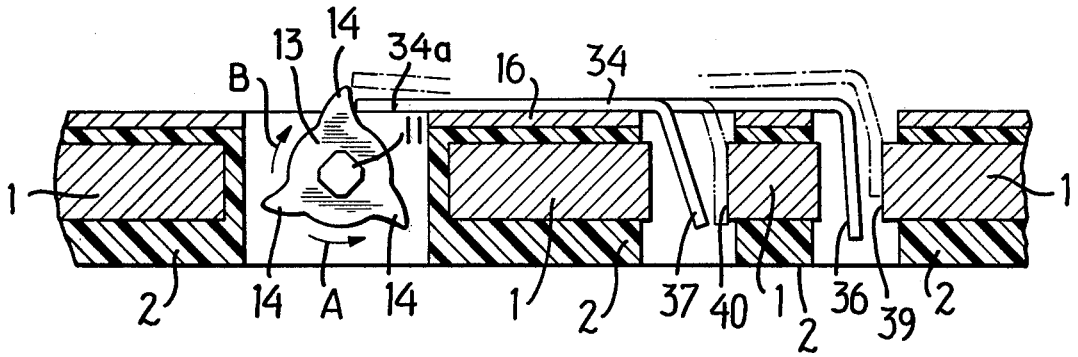
FIG. 4 is a schematic cross sectional view illustrating the construction and operation of switch means actuated by rotation of the stem of the timepiece and FIG. 5 is a circuit diagram of the electronic timepiece shown in FIG. 1.

The watch has a stem 12 having a stem shaft 11 which is rotatably and slidably mounted in a stem mounting recess portion 15 provided in the molded portion 2 of the base plate. A cam member 13 having a plurality of protruding gear portions 14, as illustrated in FIGS. 3 and 4, is mounted on the stem shaft 11 so as to be rotatable therewith but movable thereon in an axial direction. The cam member 13 has a hub portion **13*a* which is rotatably received in the stem mounting recess portion 15. The stem shaft 11 and cam member 13 are retained in the stem mounting recess portion 15 by a switch base plate 16 which is fixed to the molded portion 2 of the base plate by a plurality of screws 17**.

An actuating member 19 is rotatably mounted by a supporting shaft 22 which is mounted on the switch base plate 16 with an end of the supporting shaft 22 supported by the molded portion 2 of the base plate. A projection 20 (FIG. 3) on the actuating member 19 is received in an annular groove of a sleeve portion 18 of the stem shaft 11. The actuating member 19 is thus rotatable about the supporting shaft 22 by movement of the stem shaft 11 in an axial direction. A detent member 25 on a spring arm portion **23*a* of a supporting and pressing member 23 is fixed to the switch base plate 16 and the molded portion 2 of the base plate by screws 8 and 24 engages a projection 21 provided on the actuating member 19. The detent member 25 has in an edge portion thereof recesses 25*a* and 25*b* separated by an intervening protuberance and an inclined edge portion 25*c*. When the stem shaft 11 is in a neutral position the projection 21 is in the recess 25*b* of the detent member 25. When the stem member 11 is pulled out by means of the stem 12, the actuating member 19 is rotated about the shaft 22 from a neutral position, as indicated by a solid line in FIG. 2, to a pulled out position as indicated by a dot-dash line. The projection 21 of the actuating member 19 rides over the protuberance between the recesses 25*a* and 25*b* of the detent member 25 and stays in the recess 25*a* whereby the actuating member 19 stays in the pulled out position. On the contrary when the stem shaft 11 is pushed inwardly the actuating member 19 is rotated from the solid line position to the position indicated by the double-dot line causing the projection 21 to ride up on the inclined edge portion 25*c* of the detent member 25 whereby the actuating member 19 and the stem shaft are restored to neutral position by the spring action of the arm 23*a* of the supporting and pressing member 23** when the stem is released.

A switch plate 27 which is rotatably mounted by a shaft 30 which is mounted on the molded portion 2 of the base plate and is fixed to the switch base plate 16 has an end portion **27*a* which is received in a recess portion 26 of the actuating member 19. The switch plate 27 has contact portions 28 and 29 corresponding to switch portions 31 and 32 mounted on the base plate 1. When the actuating member 19 is located in the neutral position, as indicated by a solid line, the contact portions 28 and 29 are not in contact with the switch portions 31 and 32 respectively. However when the stem 12 is pulled out so as to rotate the actuating member to the position indicated by the dot-dash line, the switch plate 27 is rotated in a clockwise direction about the shaft 30 as a fulcrum so that the contact portion 28 makes contact with the switch portion 31. On the other hand when the stem 12 is pushed in and the actuating member 19 is rotated to the position indicated by the double-dot line, the switch plate 27 is rotated in a counterclockwise direction and the contact portion 29 makes contact with the switch portion 32. As will be explained below, a time amendment can be effected by rotary operation of the stem shaft 11 when the stem is pulled out so as to make contact between the contact portion 28 of the switch plate 27 and the corresponding switch portion 31 while a lamp (not shown) for illuminating a liquid crystal display panel is lighted by contact between the contact portion 29 of the switch plate 27 and the corresponding switch portion 32** when the stem is pushed in.

Figure 2:
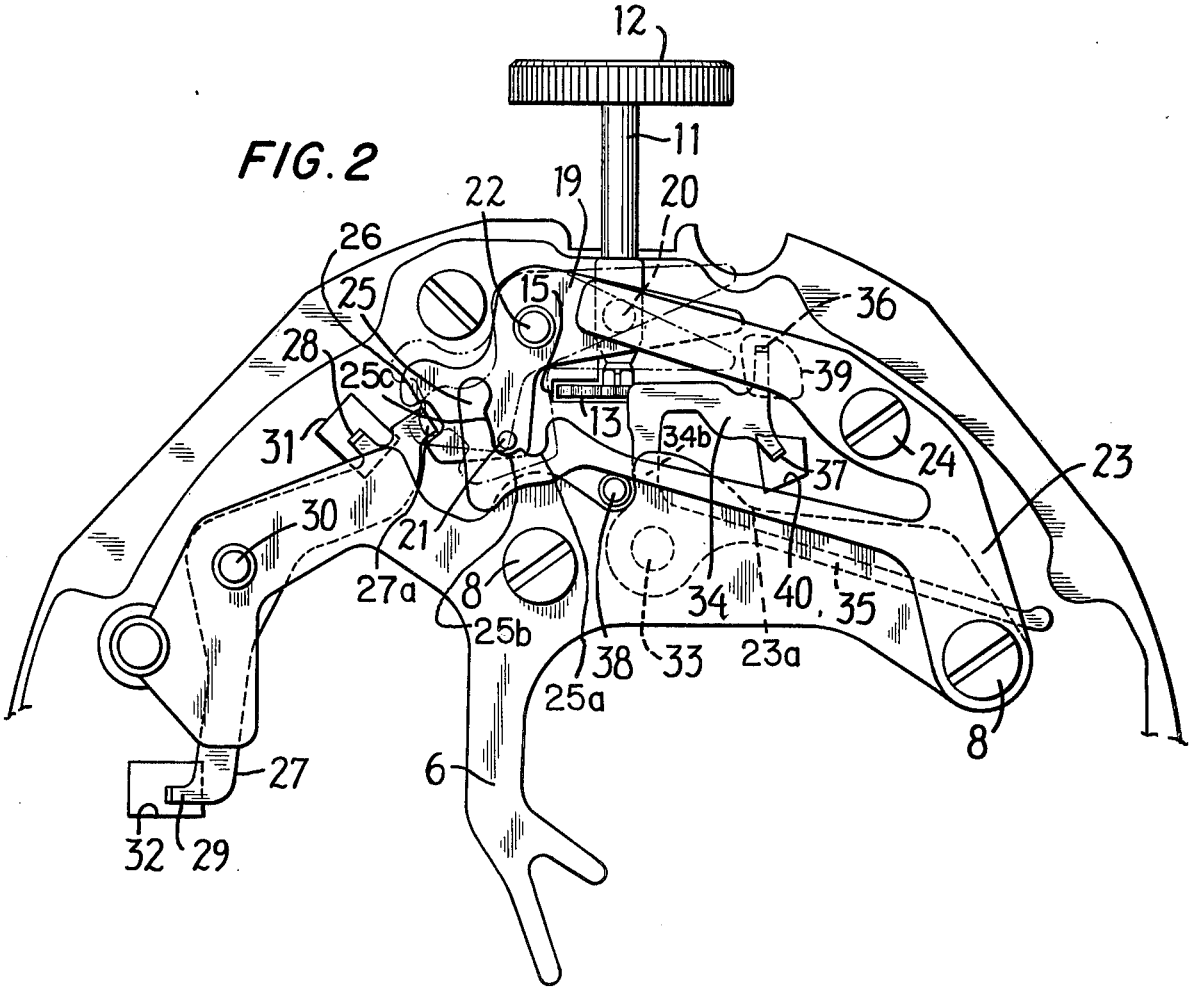
FIG. 2 is an enlarged plan view corresponding to a portion of FIG. 1.

A switch plate 34 is rotatably mounted on the switch base plate 16 by a shaft 33 and has a spring arm 35 which bears on the screw 8 for supporting the supporting and pressing member 23 so as to tend to rotate the switch plate 34 in a counterclockwise direction about the shaft 33. Rotation of the switch plate 34 in a counterclockwise direction by the spring arm 35 is limited by a pin 38 mounted on the switch base plate 16. As seen in FIGS. 2 and 4 the switch plate 34 has downwardly bent contact portions 36 and 37 which are received in openings in the base plate 1 in such position that they can be brought into contact with switch portions 39 and 40 of the base plate. Normally the contact portion 36 does not contact the switch portion 39 and the contact portion does not contact the switch portion 40.

A part 34*a* of the switch plate 34 is opposed to the cam member 13 mounted on the stem shaft 11 so that the switch plate 34 can be operated by rotation of the cam member 13. When the stem shaft 11 is rotated toward the right and the cam member 13 is rotated in the direction of the arrow A in FIG. 4 a tooth portion 14 of the cam member 13 engages the lower face of the switch plate 34 whereby this portion of the switch plate is lifted up. At the same time a part 34*b* of the switch plate is held down by the supporting and pressing member whereby the switch plate 34 is flexed so as to bring the contact portion 36 into contact with the switch portion 39 of the base plate 1, as indicated by dot-dash lines in FIG. 4. When the cam member 13 is rotated further in the direction of the arrow A so that the tooth portion 14 of the cam member rides off of the switch plate 34, the switch plate 34 is restored by its resiliency to its original position so that the contact portion 36 does not contact the switch portion 39. When the stem shaft 11 is continuously rotated toward the right the contact portion 36 is brought intermittently into contact with the switch portion 39. The numbers of times contact is made is thus controlled by rotation of the stem. As will be explained below, selection is thereby made of a time function to be amended.

When the stem shaft 11 is rotated toward the left and the cam member 13 is thereby rotated in the direction of the arrow B in FIG. 4, an edge of the switch plate 34 is engaged by one of the tooth portions 14 of the cam member 13 so that the switch plate is rotated in a clockwise direction about the shaft 33 and the contact portion 37 of the switch plate 34 is thereby brought into contact with the switch portion 40 of the base plate 1, as indicated by the double-dot line in FIG. 4. When the stem is released the switch plate 34 and cam member 13 are restored to normal position by the spring power of the spring arm 35 so that the contact portion 37 of the switch plate 34 does not contact the switch portion 40 of the base plate 1. As will be explained below, a fast forward pulse is applied to the time counter of a time function which is to be amended as long as the contact portion 37 of the switch plate 34 contacts switch portion 40. Amendment of the selected time function is thereby effected. Time amendment can be effected only when the stem shaft 11 is pulled out so that contact portion 28 of the switch plate 27 contacts the switch portion 31.

The lead portion 6 which contacts the anode electrode of the cell 3 is electrically connected to the switch plates 27 and 34. In FIG. 3 there is shown a portion of a liquid crystal display panel 41 for displaying time functions in digital form.

Figure 5:
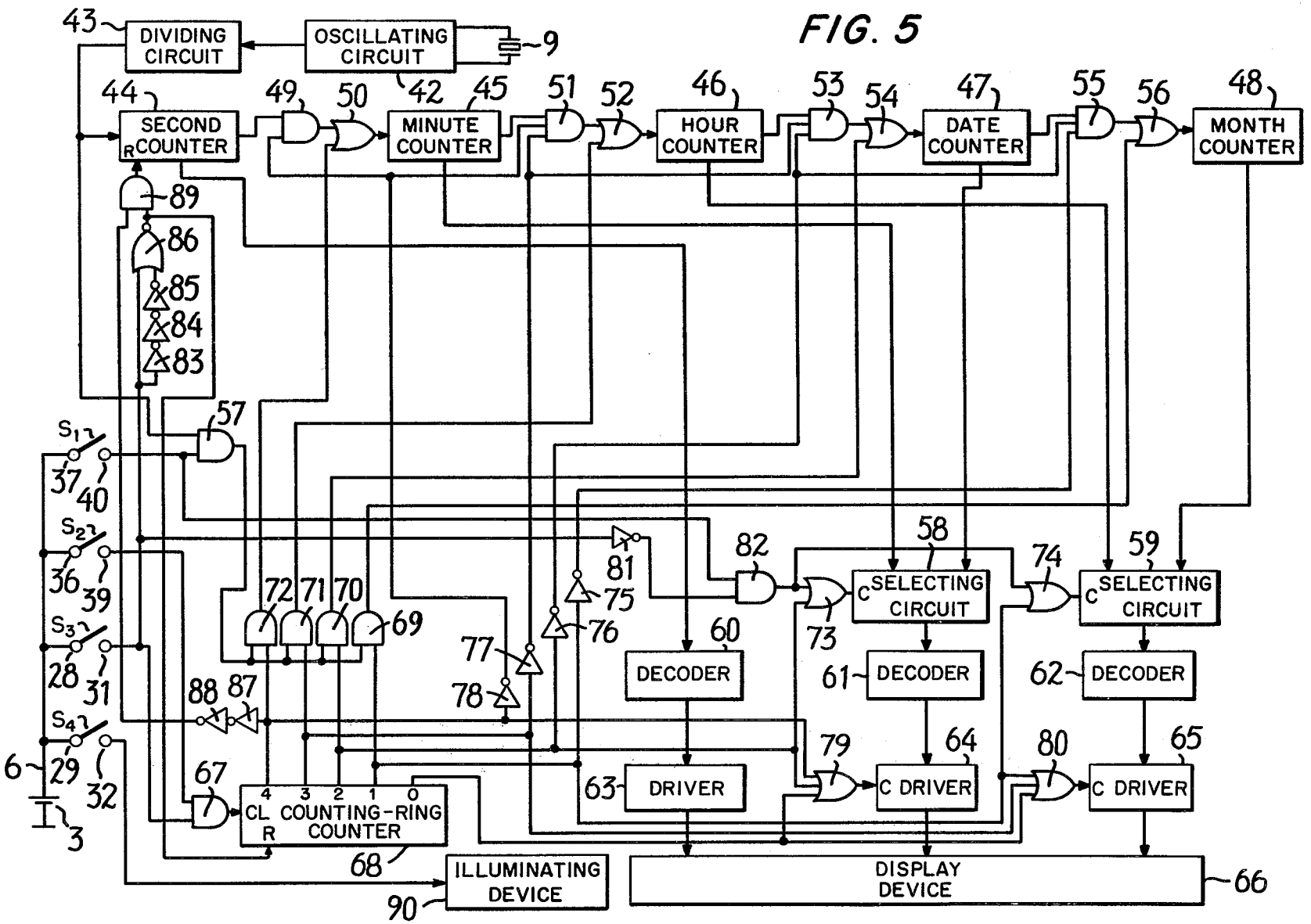

The circuit construction of an electronic timepiece in accordance with the present invention is shown in FIG. 5. The same parts are designated by the same reference numerals as in FIGS. 1 to 4.

The output signal of an oscillating circuit 42 which includes the quartz element 9 is divided to a 1 sec. pulse by a dividing circut 43. The 1 sec. pulse is applied to a second counter 44 and is also applied to one input terminal AND circuit 57, the other input terminal to which is connected to the output of a switch $S_1$ composed of the contact portion 37 of switch plate 34 and corresponding switch portion 40 of the base plate 1. A 1 min. pulse generated from the second counter 44 is applied to a minute counter 45 through an AND circuit 49 and OR circuit 50. A 1 hour pulse generated from the minute counter 45 is applied to an hour counter 46 through an AND circuit 51 and OR circuit 52. A date pulse generated from the hour counter 46 is applied to a date counter 47 through an AND circuit 53 and OR circuit 54. A month pulse generated direct from the data counter 47 is applied to a month counter 48 through an AND circuit 55 and OR circuit 56.

The counting outputs of the second counter 44 is displayed by the second display portion of a display device 66 to which the second counter in connected through a decoder 60 and driver 63. The counting output of the minute counter 45 and date counter 47 are applied to a selecting circuit 58 and are selectively displayed by the display device 66 to which the selecting circuit 58 is connected through a decoder 61 and driver 64. The counting outputs of the hour counter 46 and the month counter 48 are applied to a selecting circuit 59 and are selectively displayed by the display device 66 to which the selecting circuit 59 is connected through a decoder 62 and driver 65.

The output of a switch $S_2$ composed of the contact portion 36 of the switch plate 34 and the switch portion 39 of the base 1 is applied to one input terminal of an AND circuit 67 to the other input terminal of which is applied the output of a switch $S_3$ composed of the contact portion 28 of switch plate 27 and the switch portion 31. The output of AND circuit 67 is applied to the clock terminal CL of a five-counting ring counter 68.

The outputs "1", "2", "3" and "4" are applied respectively to one input terminal of each of AND circuits 69, 70, 71 and 72, the other input terminal of which is connected to the output of the AND circuit 57. The output of AND circuit 69 is applied to OR circuit 56, the output of AND circuit 70 is applied to OR circuit 54, the output of AND circuit 71 is applied to OR circuit 52 and the output of AND circuit 72 is applied to OR circuit 50. The output "1" of the ring counter 68 is applied to OR circuits 74 and 80 and is also applied to AND circuit 55 through an inverter 75. The ouput "2" of the ring counter 68 is applied to OR circuits 73 and 79 and is applied to AND circuits 53 and 55 through an inverter 76. The output "3" of the ring counter 68 is applied to OR circuit 80 and is applied to AND circuits 51 and 53 through an inverter 77. The output "4" of the ring counter 68 is applied to OR circuit 79 and is applied to AND circuits 49 and 51 through an inverter 78. The output "0" of the ring counter 68 is applied to OR circuits 79 and 80.

The output of switch $S_1$ and the output of switch $S_3$ inverted by the inverter 81 are supplied respectively to the inputs of an AND circuit 82. The output of the AND circuit 82 is commonly applied to OR circuits 73 and 74. The output of OR circuit 73 is applied to the control terminal C of the selecting circuit 58. The output of OR circuit 74 is applied to the control terminal C of the selecting circuit 59. The selecting circuit 58 applies the counting output of the minute counter 45 to the decoder 61 when the voltage of the control terminal C is maintained at a lower level. The selecting circuit 58 applies the counting output of the date counter 47 to the decoder 61 when the voltage of the control terminal C is maintained at a higher level. The selecting circuit 59 applies the counting output of the hour counter 46 to the decoder 62 from the voltage of the control terminal C is maintained at the lower level. The selecting circuit 59 applies the counting output of the month counter 48 to the decoder 62 when the voltage of the control terminal C is maintained at the higher level.

The output of OR circuit 79 is applied to the control terminal C of the driver 64. The output of the OR circuit 80 is applied to the control terminal C of the driver 65. The driver 64 drives the display portion of the display device 66 corresponding to the decoder 61 when the voltage of the control terminal C is maintained at the higher level. The driver 64 does not drive the display device 66 when the voltage of the control terminal C is maintained at the lower level. Likewise the driver 65 drives the display portion of the display device 66 corresponding to decoder 62 when the voltage of the control terminal C is maintained at the higher level but not when the control terminal C is maintained at the lower level.

The output of the switch $S_3$ is applied to one input terminal of a NOR circuit 86 and the output of switch $S_3$ delayed by inverters 83, 84 and 85 connected in series is applied to the other input terminal of NOR circuit 86. The output of NOR circuit 86 is applied to the reset terminal R of the ring counter 68 and is also applied to one input terminal of an AND circuit 89 to the other input terminal of which is applied the output "4" of ring counter 68 after delay by series connected inverters 87 and 88. The output of AND circuit 89 is applied to the reset terminal R of the second counter 44.

The output of a switch $S_4$ composed of the contact portion 29 of switch plate 27 and corresponding switch portion 32 is applied to an illuminating device 90 for illuminating the display device 66. The ring counter 68 is set so that the "0" output is at the higher level and the other outputs are at the lower level in response to a high level signal being applied to the reset terminal R. The ring counter 68 is normally maintained in such condition.

The operation of the embodiment of the invention illustrated in the drawings and described above will now be described.

In normal condition namely when the stem shaft 11 is maintained in neutral position, the switches $S_1$, $S_2$, $S_3$ and $S_4$ are respectively maintained in OFF-state. The outputs of OR circuits 73 and 74 are maintained at the lower level and the outputs of OR circuits 79 and 80 are at the higher level. Therefore the counting outputs of the minute counter 45 and hour counter 46 are applied by the selecting circuits 58 and 59 to decoders 61 and 62 and moreover drivers 64 and 65 are operated so that the hour, minute and second figures are displayed by the display device 66 in the normal condition. When the switch $S_1$ is operated to ON-state by rotating the stem shaft to the left by stem 12 with the stem shaft 11 maintained in neutral position axially, the output of AND circuit 82 becomes to the higher level and the outputs of OR circuits 73 and 74 become to the higher level so that the counting output of the date counter 47 is selected by the selecting circuit 58 and is applied to the decoder 61. The counting output of the month counter 48 in like manner is selected by the selecting circuit 58 and is applied to the decoder 62. Therefore month and date figures are displayed by the display device 66 instead of hour and minute figures. When the stem 12 is released the stem shaft 11 is restored to the normal position whereby the switch $S_1$ is changed to the OFF state and the hour and minute figures are again displayed by the display device 66.

In case it is desired to effect a time amendment the switch $S_3$ is changed to the ON state by pulling the stem shaft 11 by means of the stem 12. When the stem shaft 11 is rotated by means of the stem 12 120° the switch $S_2$ is operated once so that one pulse signal of higher level is applied to the clock terminal CL of the ring counter 68 through the AND circuit 67. Therefore the "1" output of the ring counter 68 becomes to the higher level and the "0" output and other outputs become to the lower level. In this condition the output of OR circuit 73 becomes to the higher level and the output of OR circuit 79 becomes to the lower level whereby only the month figure is displayed in the display device 66 and amendment of the month figure is designated. If the stem shaft 11 is now rotated toward the left by the stem 12, the switch $S_1$ is changed to the ON-state so that a 1 sec. pulse generated by the dividing circuit 43 is applied to the month counter 48 as a fast forward pulse passing through AND circuits 57 and 69 and OR circuit 56. The contents of the month counter 48 is thereby speedily amended and is displayed by the display device 66. When the contents of the month counter 48 as displayed by the display device 66 reaches the desired month the stem 12 is released so that the switch $S_1$ is changed to the OFF-state and the supply of fast forward pulses to the month counter 48 is stopped whereby amendment of the month figure is accomplished.

When the stem 12 is again rotated 120° to the right, one pulse is applied to the clock terminal CL of the ring counter 68 whereby the "2" output of the ring counter becomes to the higher level and the other outputs become to the lower level. In this condition normally the date figure is displayed by the display device 66 whereby amendment of the date figure is designated. To amend the date figure the fast forward pulse is applied to the date counter 47 when switch $S_1$ is changed to the ON-state by rotating the stem shaft 11 toward the left. The contents of the date counter 47 is speedily changed whereby the desired amendment is effected.

By again rotating the stem 12 120° to the right another pulse is applied to the clock terminal CL of the ring counter 66 whereby the "3" output becomes to the higher level and the other outputs become to the lower level. In this condition only the hour figure is displayed by the display device 66 whereby amendment of the hour figure is designated. The desired amendment is effected in like manner by turning the stem shaft 11 toward the left to apply the fast forward pulse to the hour counter 46 until the desired amendment has been effected. In like manner amendment of the minute figure is effected by again turning the stem 12 120° to the right to apply another pulse to the clock terminal CL of the ring counter 68 so that the "4" output of the ring counter 68 is at the higher level and the other outputs are at the lower level. Time amendment of the minute figure is then accomplished by repeating the operation described above so as to apply the fast forward pulse to the minute counter 45 until the desired amendment is accomplished.

If the stem shaft 11 is moved axially by the stem 12 to restore it to the normal position, switch $S_3$ is changed to the OFF-state whereupon a reset pulse of higher level having a certain width by reason of the delay time of inverters 83, 84 and 85 is generated by the NOR circuit 86 whereby the ring counter 68 and second counter 44 are reset to normal condition.

In case of the display of the displayed device not being visible at night the stem shaft 11 is pushed inwardly by the stem 12 so as to operate switch $S_4$ to the ON-state thereby illuminating the illuminating device 90 so that the time can be easily read.

In the above noted condition of the stem shaft 11 being pulled out, if the stem shaft is rotated toward the right the time amending figure is sequentially designated. If the stem shaft 11 is rotated toward the left the time amendment of the designated figure is effected. Therefore these time amending operations are very similar to operations for a conventional watch and are thus easily and naturally carried out by the user.

According to the present invention at least two operational portions are provided on a switch member operated by a cam member on the stem shaft. With this arrangement selection of the time function (month, date, hours, or minutes) to be amended is effected by rotation of the stem shaft in one direction while the desired amendment of the selected function is effected by rotation of the stem shaft in the opposite direction. It is therefore possible to accomplish time amendment solely by operation of the stem shaft without push buttons or other means such as are commonly used on digital electronic watches. It is therefore possible to accomplish time amendment in much the same manner as with a conventional mechanical watch having hands.

The invention is particularly applicable to an electronic timepiece having a display device driven by alternating current so as to reduce power consumption and thereby prolong battery life. However it will be understood that many changes and modifications can be made and that the invention is in no way limited to the particular embodiment shown by way of example in the drawings and described above.

What is claimed is:

1. An electronic timepiece comprising in combination a base plate, a stem member mounted for rotary movement and axial movement relative to said base plate, a cam member on said stem member and rotatable therewith, electronic circuitry on said base plate including first function-controlling switch means actuatable by axial movement of said stem member and second function-controlling switch means actuatable by said cam member upon rotation of said stem member, said second function-controlling switch means comprising first and second switch portions on said base plate and a spring switch plate mounted on said base plate and having first and second contact portions engageable respectively with said first and second switch portions on said base plate, said switch plate being engageable by said cam member when rotated in one direction to bring said first contact portion of said switch plate into engagement with said first switch portion on said base plate and being engageable by said cam member when rotated in the opposite direction to bring said second contact portion of said switch plate into engagement with said second switch portion on said base plate.

2. An electronic timepiece according to claim 1, in which said base plate has holes in which said switch portions are located and into which said first and second contact portions of said switch plate extend.

3. An electronic timepiece according to claim 1, in which said circuitry comprises time display means and time amending means and in which said first function-controlling switch means comprises means operable in one axial position of said stem member to provide time display and operable in another axial position of said stem member to provide time amendment.

4. An electronic timepiece according to claim 3, in which said second function-controlling switch means controls said display means and is operable by rotary movement of said stem member selectively to display time and date when said stem member is in axial position for time display.

5. An electronic timepiece according to claim 3, in which said circuitry includes oscillator means, frequency dividing means, minute, hour, month and date counters and a ring counter for selecting a time function to be amended, and in which said second function-controlling switch means is operable by rotation of said stem member in one direction selectively to step said ring counter to select a time function to be amended and is operable by rotation of the stem member in the opposite direction to connect said dividing means to the counter of the selected time function to supply pulses to the selected counter to amend the selected time function, when said stem member is in axial position for time amendment.

6. An electronic timepiece according to claim 3, in which said circuitry includes means for lighting said display means and in which said first function-controlling switch means controls said display lighting means and is operable by axial movement of said stem member to a third axial position to light display means.

7. An electronic timepiece according to claim 1, in which said switch plate is pivotally mounted on said base plate for pivoted movement in a plane parallel to said base plate.

8. An electronic timepiece according to claim 7, in which said switch plate has an integral spring arm portion engaging an abutment on said base plate to bias said switch plate to a normal position.

9. An electronic timepiece according to claim 7, comprising means for biasing said switch plate to a normal position, said cam member having a projecting portion engageable with an edge of said switch plate when said cam member is rotated in one direction to turn said switch plate about its pivot against said bias to bring one only of said contact portions into engagement with the corresponding one of said switch portions on said base plate.

10. An electronic timepiece according to claim 9, in which said projecting portion of said cam member is engageable with an underface of said switch plate when said cam member is rotated in the opposite direction to flex said switch plate and thereby bring only the other of said contact portions into engagement with the other of said switch portions on said base plate.

11. An electronic timepiece according to claim 1, in which said first function-controlling switch means comprises third and fourth contact portions on said base plate, a second switch plate pivotally mounted on said base plate and having third and fourth contact portions engageable respectively with said third and fourth switch portions on said base plate and means operatively connecting said second switch plate with said stem to pivot said second switch plate by axial movement of said stem selectively to a first position in which neither of said contact portions engages the respective switch portion on said base plate, a second position in which said third contact portion engages said third switch portion and a third position in which said fourth contact portion engages said fourth switch portion.

12. An electronic timepiece according to claim 11, in which said base plate has holes in which said third and fourth switch portions are located and into which said third and fourth contact portions of said second switch plate extend.

13. An electronic timepiece according to claim 11, in which said means operatively connecting said second switch plate with said stem comprises an actuating member pivotally mounted on said base plate and having a portion engageable with said second switch plate and a portion engageable with said stem for pivoting said actuating member by an axial movement of said stem.

14. An electronic timepiece according to claim 13, further comprising spring detent means for releasably retaining said actuating member in a first position and a second position and biasing means for biasing said actuating member from a third position to said second position.

* * * * *